US010745240B2

(12) United States Patent
Fauconnet et al.

(10) Patent No.: US 10,745,240 B2
(45) Date of Patent: Aug. 18, 2020

(54) ELEVATOR OPERATION AND SERVICE PANEL

(71) Applicants: Otis Elevator Company, Farmington, CT (US); Aurélien Fauconnet, Isdes (FR)

(72) Inventors: Aurélien Fauconnet, Isdes (FR); Nicolas Guillot, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 369 days.

(21) Appl. No.: 15/560,880

(22) PCT Filed: Mar. 23, 2015

(86) PCT No.: PCT/IB2015/000518
§ 371 (c)(1),
(2) Date: Sep. 22, 2017

(87) PCT Pub. No.: WO2016/151350
PCT Pub. Date: Sep. 29, 2016

(65) Prior Publication Data

US 2018/0118508 A1 May 3, 2018

(51) Int. Cl.
*B66B 1/46* (2006.01)
*B66B 19/00* (2006.01)
*B66B 5/00* (2006.01)

(52) U.S. Cl.
CPC ..... *B66B 1/466* (2013.01); *B66B 5/0062* (2013.01); *B66B 19/007* (2013.01)

(58) Field of Classification Search
CPC ..... B66B 1/466; B66B 19/007; B66B 5/0062
USPC ..... 187/395
See application file for complete search history.

(56) References Cited

U.S. PATENT DOCUMENTS 6,227,335 B1 * 5/2001 Koeppe, Jr. ..... B66B 1/462 187/395
6,357,553 B1 3/2002 Vialonga
6,691,833 B1 2/2004 Elsener et al.
6,739,432 B2 5/2004 Elsener
(Continued)

FOREIGN PATENT DOCUMENTS

CN 203439862 U 2/2014
EP 1564176 A1 8/2005
(Continued)

OTHER PUBLICATIONS

Chinese First Office Action for application 201580078188.4, dated Mar. 4, 2019, 8 pages.
(Continued)

*Primary Examiner* — Jeffrey Donels
(74) *Attorney, Agent, or Firm* — Cantor Colburn LLP

(57) ABSTRACT

A multi-use interface for use in an elevator includes an input device to receive input and a selection device associated with the input device, the selection device to select between an operation mode and a service mode, wherein the operation mode allows the input device to receive a standard elevator function input, the multi-use interface generating a standard elevator function output in response to the standard elevator function input, and the service mode allows the input device to receive a service function input, the multi-use interface generating a service function output in response to the service function input.

13 Claims, 6 Drawing Sheets

(56) References Cited

U.S. PATENT DOCUMENTS

| | | | | |
|---|---|---|---|---|
| 7,798,291 | B2 * | 9/2010 | Felder | B66B 5/021 187/395 |
| 8,316,998 | B2 | 11/2012 | Henseler | |
| 2004/0055828 | A1 | 3/2004 | Kavounas | |
| 2004/0245052 | A1 | 12/2004 | Felder | |
| 2014/0076670 | A1 | 3/2014 | Henseler | |

FOREIGN PATENT DOCUMENTS

| | | | |
|---|---|---|---|
| EP | 1967477 | A1 | 9/2008 |
| EP | 1433734 | B1 | 10/2011 |
| EP | 2690050 | A1 | 1/2014 |
| EP | 2765108 | A1 | 8/2014 |
| JP | H09110325 | A | 4/1997 |
| JP | H10194622 | A | 7/1998 |
| JP | 2003238039 | A | 8/2003 |
| JP | 2007091430 | A | 4/2007 |
| JP | 2009256008 | A | 11/2009 |
| JP | 2011256006 | A | 12/2011 |
| JP | 2013035610 | A | 2/2013 |
| WO | 0044662 | A1 | 8/2000 |
| WO | 0179104 | A1 | 10/2001 |
| WO | 2006064307 | A1 | 6/2006 |

OTHER PUBLICATIONS

Elevatorpedia, "Inspection service (INS)" available at: http://elevation.wikia.corn/wiki/Inspection_service_(INS), accessed Sep. 22, 2017, 4pgs.

International Search Report and Written Opinion for application PCT/IB2015/000518, dated Nov. 19, 2015, 9pgs.

* cited by examiner

ELEVATOR OPERATION AND SERVICE PANEL

FIELD OF THE INVENTION

The subject matter disclosed herein relates generally to the field of elevators, and more particularly to a multi-purpose user and service interface.

DESCRIPTION OF RELATED ART

Elevator systems may require maintenance and repairs in order to allow for desired operation. Traditionally, certain maintenance and repair operations are performed within the elevator pit, or otherwise outside the elevator car, requiring additional time. Maintenance and repair operations performed within the elevator pit, or otherwise outside the elevator car, often requires additional hoistway volume to allow for access and to comply with regulations, which may not be architecturally desirable. In order to reduce service time, reduce required hoistway volume, and comply with regulations, it is desired to perform elevator maintenance and repair from within the elevator car.

In order to access serviceable components from within the elevator car, the interior of the elevator car may require access panels or trap doors located on the ceiling, floor, or walls of the elevator car that can be removed, opened and/or replaced. Removable access panels may not be aesthetically pleasing and may allow unauthorized access to service areas. A device and method that can allow for the authorized removal of panels with minimal aesthetic impact is desired.

BRIEF SUMMARY

According to an embodiment of the invention, a multi-use interface for use in an elevator includes an input device to receive input, and a selection device associated with the input device, the selection device to select between an operation mode and a service mode, wherein the operation mode allows the input device to receive a standard elevator function input, the multi-use interface generating a standard elevator function output in response to the standard elevator function input, and the service mode allows the input device to receive a service function input, the multi-use interface generating a service function output in response to the service function input.

In addition to one or more of the features described above, or as an alternative, further embodiments could include that the standard elevator function input includes at least one of a floor selection, and a door operation.

In addition to one or more of the features described above, or as an alternative, further embodiments could include that the service function input includes at least one of a panel lock operation, a panel unlock operation, a panel release operation, a raise elevator car operation, and a lower elevator car operation.

In addition to one or more of the features described above, or as an alternative, further embodiments could include that the multi-use interface is associated with at least one mechanically releasable panel.

In addition to one or more of the features described above, or as an alternative, further embodiments could include that the multi-use interface is associated with at least one magnetically releasable panel.

In addition to one or more of the features described above, or as an alternative, further embodiments could include that the selection device includes a locking mechanism to selectively allow selection of the service mode.

In addition to one or more of the features described above, or as an alternative, further embodiments could include that the service mode is selected with a key.

In addition to one or more of the features described above, or as an alternative, further embodiments could include that the service mode is selected by a sequence entered with the input device.

In addition to one or more of the features described above, or as an alternative, further embodiments could include that the service mode is selected with a proximity device.

In addition to one or more of the features described above, or as an alternative, further embodiments could include the multi-use interface further includes a display associated with the selection device to display an output corresponding to the operation mode and the service mode.

According to an embodiment of the invention, a method to service an elevator includes, providing a multi-use interface including an input device and a selection device, selecting between an operation mode and a service mode via the selection device, receiving an input via the input device, receiving a standard elevator function input if the operation mode is selected, generating a standard elevator function output in response to the standard elevator function input, receiving a service function input if the service mode is selected, and generating a service function output in response to the service function input In addition to one or more of the features described above, or as an alternative, further embodiments could include that the standard elevator function input includes at least one of a floor selection, and a door operation.

In addition to one or more of the features described above, or as an alternative, further embodiments could include that the service function input includes at least one of a panel lock operation, a panel unlock operation, a panel release operation, a raise elevator car operation, and a lower elevator car operation.

In addition to one or more of the features described above, or as an alternative, further embodiments could include selectively allowing selection of the service mode via a locking mechanism.

In addition to one or more of the features described above, or as an alternative, further embodiments could include unlocking the locking mechanism via a key.

Technical function of the embodiments described above includes a selection device associated with the input device, the selection device to select between an operation mode and a service mode, wherein the operation mode allows the input device to receive a standard elevator function input, the multi-use interface generating a standard elevator function output in response to the standard elevator function input, and the service mode allows the input device to receive a service function input, the multi-use interface generating a service function output in response to the service function input.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1:
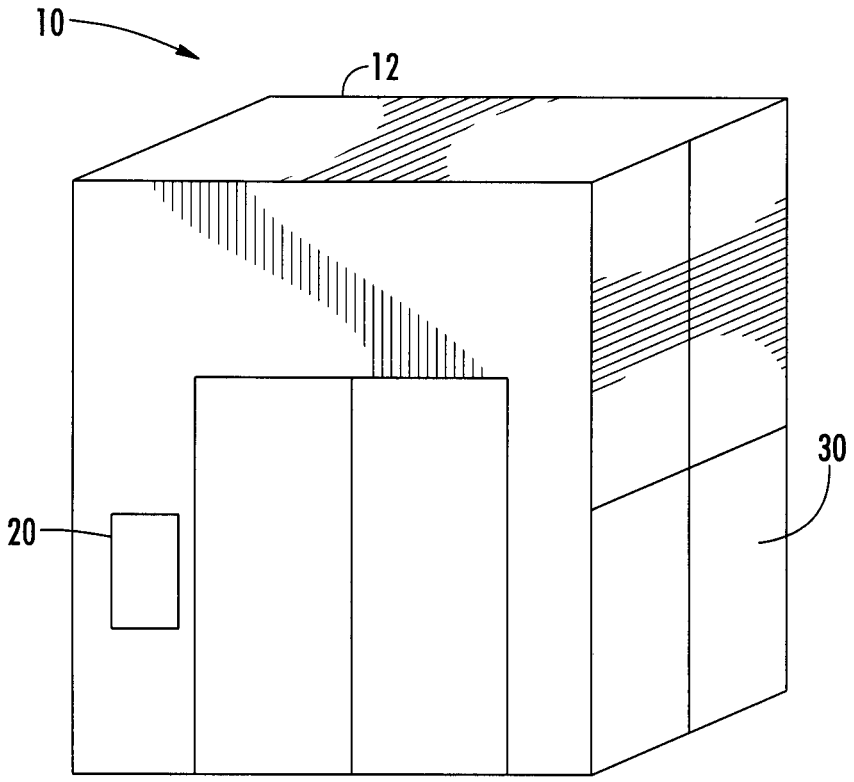
FIG. 1 depicts an elevator car in an exemplary embodiment.

FIG. 1 depicts an elevator system 10 in an exemplary embodiment. In an exemplary embodiment, the elevator system 10 includes an elevator car 12, a multi-use interface 20, and releasable panels 30. The elevator car 12 may be one of multiple elevator cars for use in an elevator system 10. During normal operation the elevator car 12 may be utilized to transport passengers, cargo, etc., wherein end users can utilize the multi-use interface 20 to select floors and control other elevator functions. In an exemplary embodiment, maintenance, inspection, and/or repair operations require access to components disposed outside of the passenger compartment of the elevator car 12. In an exemplary embodiment, elevator technicians and other authorized personnel can remove releasable panels 30 to access components disposed outside of the passenger compartment of the elevator car 12 by using the multi-use interface 20.

Figure 2A:
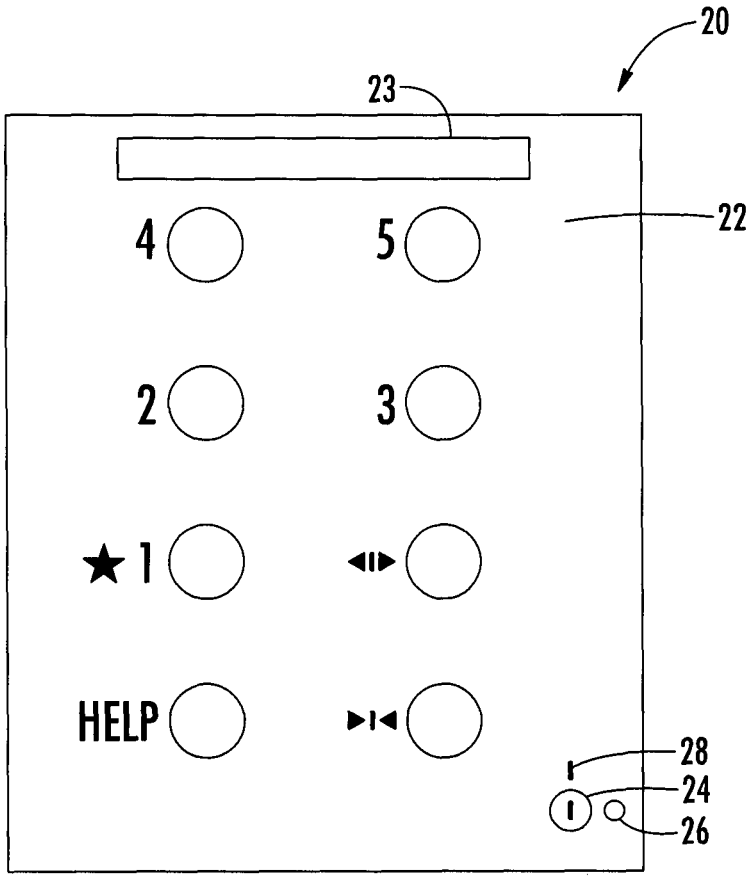
FIG. 2A shows a multi-use interface for use in an elevator car, such as the elevator car depicted in FIG. 1, with an operation mode selected.

FIG. 2A depicts the multi-use interface 20 in an exemplary embodiment. In an exemplary embodiment, the multi-use interface 20 includes an input device 22 and a selection device 24. In an exemplary embodiment, the input device 22 is any suitable input device, including, but not limited to a standard elevator input interface, a numeric keypad, a touch screen, etc. During normal operation, users can select a desired floor, door open functions, door closed functions, etc. In an exemplary embodiment, a user is not able to remove or release any releasable panels 30. In certain embodiments, the multi-use interface 20 includes a display 23 to show information relevant to a current mode. In an exemplary embodiment, the selection device 24 allows for selection between an operation mode 26 and a service mode 28. In certain embodiments, the selection device 24 is associated with a processing device that receives commands from the input device 22 to perform the desired function in accordance with the selected mode. In certain embodiments, the processing device can process, transmit and receive standard elevator functions in the operation mode 26 and lock and release panels in the service mode 28.

Referring to FIG. 2A, the selection device 24 is shown with an operation mode 26 selected. In operation mode 26, the input device can receive standard elevator function inputs. Standard elevator function inputs may include floor calls, door open functions, door close functions, help/distress calls, etc. In an exemplary embodiment, the multi-use interface 20 can generate standard elevator function outputs in response to standard elevator function inputs. In certain embodiments, the standard elevator function outputs are sent to appropriate control devices. In an exemplary embodiment, the functionality of the input device 22 corresponding to the operation mode 26 is indicated on the input device 22. In certain embodiments, the display 23 can display parameters relevant to operation mode 26, including, but not limited to current floor, desired floor, car status, etc.

Advantageously, the use of the selection device 24 allows multi-use interface 20 to receive typical elevator function inputs in operation mode 26, while allowing access to the releasable panels 30 in service mode 28. Selection device 24 allows for a single input device 22 that prevents unauthorized access while maintaining aesthetics within the elevator car 12. Further, the number of components within elevator car 12 may be reduced.

Figure 2B:
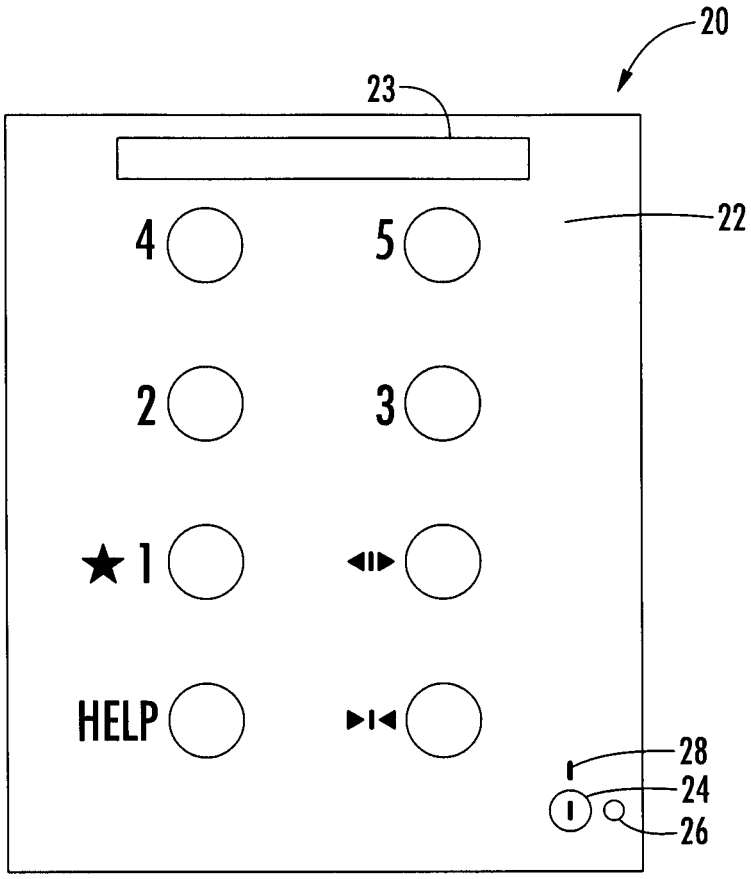
FIG. 2B shows the multi-use interface of FIG. 2A with a service mode selected.

In an exemplary embodiment, the selection device 24 includes a locking mechanism. As shown in FIGS. 2A and 2B, in an exemplary embodiment, the locking mechanism requires a key or other form of authentication to select between the service mode 28 and the operation mode 26. In certain embodiments, locking mechanism can be a mechanical locking mechanism, including but not limited to a keyed mechanism, a combination mechanism, a hidden release, etc. In certain embodiments, the locking mechanism can be an electronic locking mechanism, such as a passcode device, a proximity sensor, etc. In certain embodiments, the locking mechanism can be any suitable mechanism.

In FIG. 2B, the selection device 24 is shown with a service mode 28 selected. In an exemplary embodiment, when selection device 24 is in service mode 28, the input device 22 can be utilized to remove or release releasable panels 30. In an exemplary embodiment, in service mode 28, selections using the input device 22 can correspond to a selected releasable panel 30. In other embodiments, the input device 22 can be utilized in any suitable manner to remove or release the releasable panels 30. In certain embodiments, in service mode 28, selections using the input device can correspond to other maintenance operations including, but not limited to raising and lowering the elevator car. In an exemplary embodiment, the multi-use interface 20 can generate service function outputs in response to service function inputs. In certain embodiments, the service function outputs are sent to appropriate control devices, including, but not limited to, releasable panels 30, or control devices associated with releasable panels 30. In certain embodiments, display 23 can display relevant information, including, but not limited to service functions corresponding to the inputs of input device 22, service parameters, current status, etc.

Figure 3:
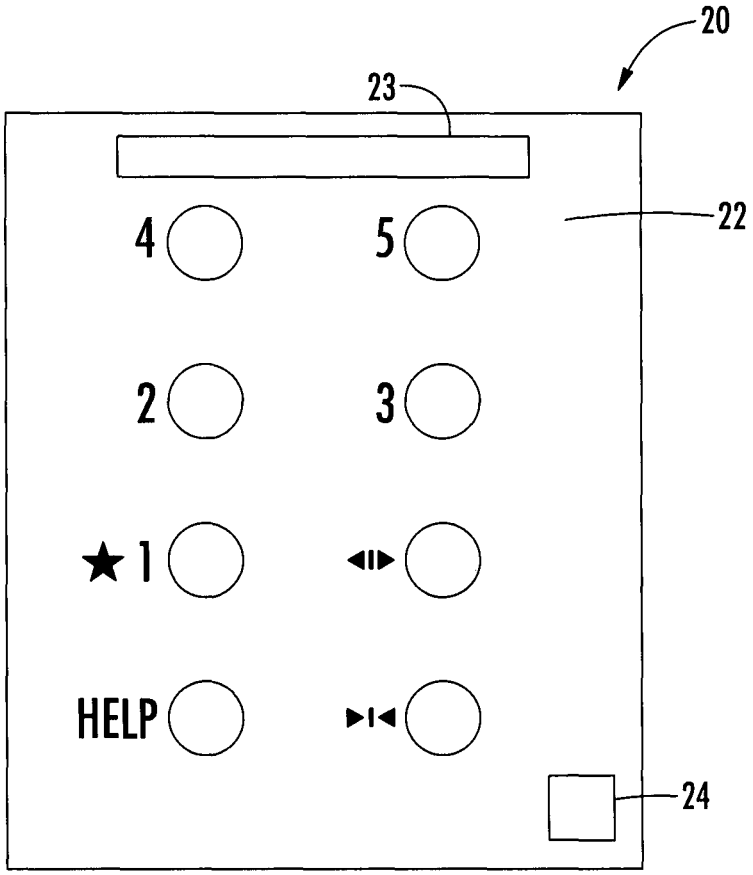
FIG. 3 shows another multi-use interface for use in an elevator car, such as the elevator car depicted in FIG. 1.

FIG. 3 shows an alternative embodiment of the multi-use interface 20 with a proximity sensing selection device 24. In certain embodiments, a technician can present an appropriate credential to select a service mode to allow use of the input device 22 to release and/or remove releasable panels 30. In certain embodiments, proximity sensing selection device 24 can utilize RFID, Bluetooth, near field communication, etc. In certain embodiments, proximity sensing selection device 24 can be used in conjunction with a combination or a keyed locking mechanism as previously described.

Figure 4:
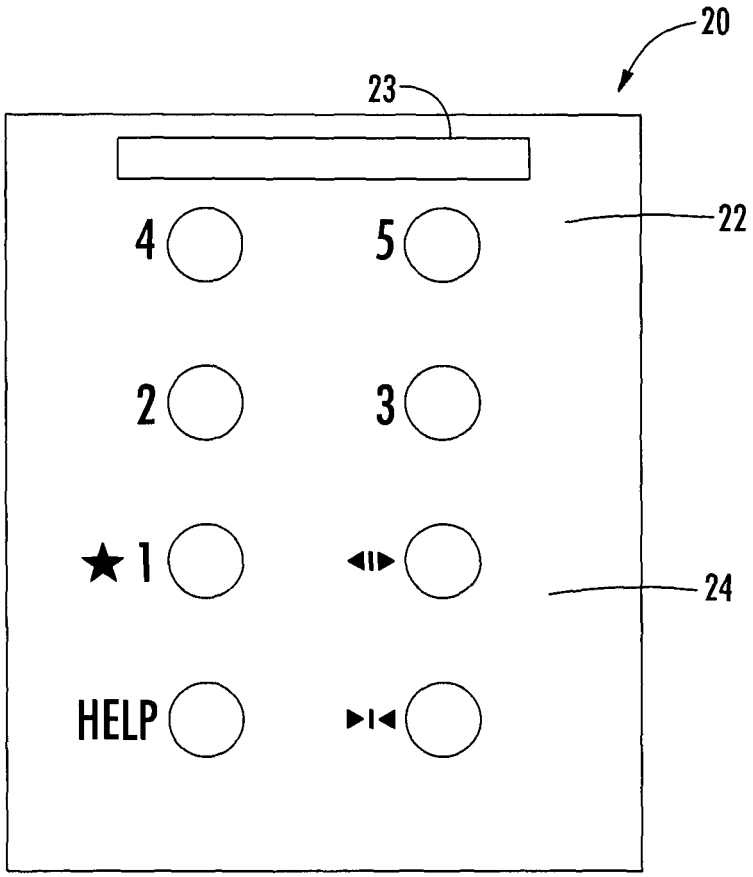
FIG. 4 shows yet another multi-use interface for use in an elevator car, such as the elevator car depicted in FIG. 1.

FIG. 4 shows an alternative embodiment of the multi-use interface 20 with the selection device 24 integrated with the input device 22. In certain embodiments, a technician can input a predetermined access code, combination of inputs, etc. to gain access to the service mode 28. Similarly, an access code, combination of inputs, etc. can be utilized to revert to an operation mode.

Figure 5A:
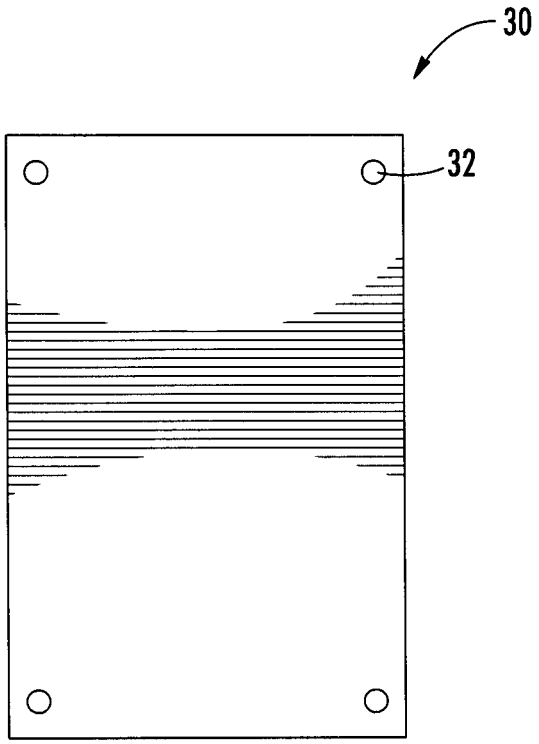
FIG. 5A shows a releasable panel for use in an elevator car, such as the elevator car depicted in FIG. 1.

FIG. 5A shows an exemplary embodiment of the releasable panels 30 for use in an elevator car 12. In an exemplary embodiment, the releasable panels 30 can include mechanically releasable fasteners 32, wherein the fasteners 32 or actuators associated with the fasteners 32 are controlled by the multi-use interface 20. The fasteners 32 may be electrically controlled and include an actuator that retracts the fastener 32 in response to a control signal from multi-use interface 20. For example, a fastener 32 may include a solenoid and a latch, where the latch may be retracted by applying power to the solenoid. A spring may be used to bias the latch in a latched position.

In certain embodiments, the fasteners 32 can selectively engage and disengage with fixed portions of a structure, while in other embodiments, the fasteners 32 can selectively engage and disengage with other releasable panels 30. In certain embodiments, the fasteners 32 can include, but are not limited to cam locks, latches, etc. In an exemplary embodiment, the releasable panels 30 can be selectively removed from within the elevator car 12 to allow access to components for inspection, repair, and/or maintenance. In certain embodiments, the releasable panels 30 can be replaced and reengaged via the multi-use interface 20.

Figure 5B:
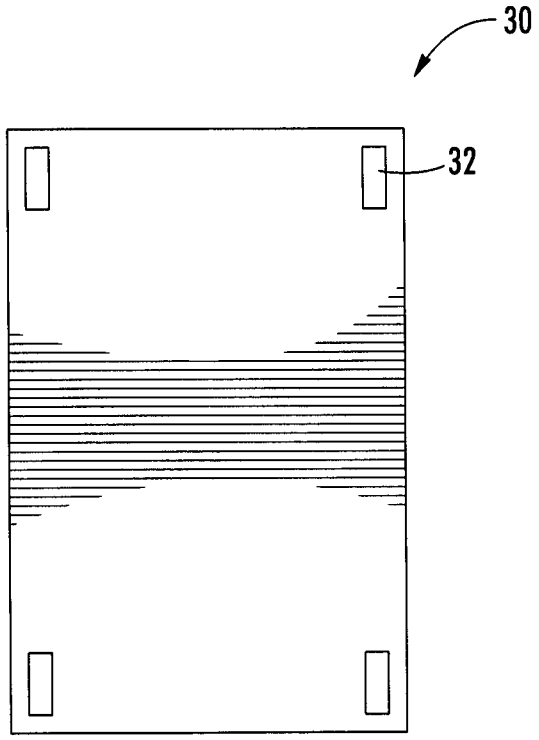
FIG. 5B shows another releasable panel for use in an elevator car, such as the elevator car depicted in FIG. 1.

FIG. 5B shows an alternative embodiment of the releasable panel 30 include a magnetically releasable fastener 32. In certain embodiments, the releasable panels 30 can be released, removed, and attached with magnetically releasable fasteners 32 or actuators associated with the fasteners 32. In certain embodiments, magnetically releasable fasteners 32 can engage and disengage with other magnetic materials present in an elevator car structure in response to a control signal from multi-use interface 20. For example, a control signal from multi-use interface 20 may be used to alter magnetic polarity of fastener 32 or other component to disrupt magnetic attraction between the fastener and another component. In other embodiments, the magnetically releasable fasteners 32 can magnetically actuate other components to engage and disengage releasable panels 30 in response to a control signal from multi-use interface 20.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A multi-use interface for use in an elevator, the multi-use interface comprising:

an input device to receive input; and a selection device associated with the input device, the selection device to select between an operation mode and a service mode, wherein the operation mode allows the input device to receive a standard elevator function input, the multi-use interface generating a standard elevator function output in response to the standard elevator function input, and the service mode allows the input device to receive a service function input, the multi-use interface generating a service function output in response to the service function input;

wherein the multi-use interface is associated with at least one mechanically or magnetically releasable panel.

2. The multi-use interface of claim 1, wherein the standard elevator function input includes at least one of a floor selection, and a door operation.

3. The multi-use interface of claim 1, wherein the service function input includes at least one of a panel lock operation, a panel unlock operation, a panel release operation, a raise elevator car operation, and a lower elevator car operation.

4. The multi-use interface of claim 1, the selection device including a locking mechanism to selectively allow selection of the service mode.

5. The multi-use interface of claim 4, wherein the service mode is selected with a key.

6. The multi-use interface of claim 4, wherein the service mode is selected by a sequence entered with the input device.

7. A multi-use interface for use in an elevator, the multi-use interface comprising:

an input device to receive input; and a selection device associated with the input device, the selection device to select between an operation mode and a service mode, wherein the operation mode allows the input device to receive a standard elevator function input, the multi-use interface generating a standard elevator function output in response to the standard elevator function input, and the service mode allows the input device to receive a service function input, the multi-use interface generating a service function output in response to the service function input;

the selection device including a locking mechanism to selectively allow selection of the service mode;

wherein the service mode is selected with a proximity device.

8. The multi-use interface of claim 1, the multi-use interface further comprising a display associated with the selection device to display an output corresponding to the operation mode and the service mode.

9. A method to service an elevator, the method comprising:

providing a multi-use interface including an input device and a selection device;

selecting between an operation mode and a service mode via the selection device;

receiving an input via the input device;

receiving a standard elevator function input if the operation mode is selected;

generating a standard elevator function output in response to the standard elevator function input;

receiving a service function input if the service mode is selected; and generating a service function output in response to the service function input;

wherein the multi-use interface is associated with at least one mechanically or magnetically releasable panel.

10. The method of claim 9, wherein the standard elevator function input includes at least one of a floor selection, and a door operation.

11. The method of claim 9, wherein the service function input includes at least one of a panel lock operation, a panel unlock operation, a panel release operation, a raise elevator car operation, and a lower elevator car operation.

12. The method of claim 9, further comprising selectively allowing selection of the service mode via a locking mechanism.

13. The method of claim 12, further comprising unlocking the locking mechanism via a key.

* * * * *